United States Patent [19]

Chambers et al.

[11] Patent Number: 4,674,815

[45] Date of Patent: Jun. 23, 1987

[54] ELECTRICAL CONNECTORS

[76] Inventors: Jeffrey Chambers, 4 Devonshire Road, Ulverston, Cumbria, England; Robert F. Oxley, 89a Route de Florissant, 1206 Geneva, Switzerland

[21] Appl. No.: 764,198

[22] Filed: Aug. 9, 1985

[30] Foreign Application Priority Data

Aug. 9, 1984 [GB] United Kingdom ..... 8420222

[51] Int. Cl.[4] ..... H01R 13/424; H01R 13/66

[52] U.S. Cl. ..... 439/592; 333/185; 439/620; 439/873

[58] Field of Search ..... 333/181, 182, 183, 184, 333/185; 339/60 R, 60 M, 94 R, 94 M, 147 R, 147 P, 217 R, 217 PS, 59 R, 59 L, 59 M

[56] References Cited

U.S. PATENT DOCUMENTS

| | | | |
|---|---|---|---|
| 3,076,168 | 1/1963 | Keen | 339/60 M |
| 3,249,907 | 5/1966 | Hewitson | 339/60 M |
| 3,710,285 | 1/1973 | Schor et al. | 339/147 P |

FOREIGN PATENT DOCUMENTS

| | | | |
|---|---|---|---|
| 767307 | 1/1957 | United Kingdom | 339/94 M |
| 2077523 | 12/1981 | United Kingdom | 339/59 R |

*Primary Examiner*—Eugene F. Desmond

*Assistant Examiner*—Gary F. Paumen

*Attorney, Agent, or Firm*—John S. Hale

[57] ABSTRACT

An electrical connector comprising a metal plate (30) containing a plurality of apertures (32). Disposed on each side of the plate (30) is a resilient rubber plug (42,44). Pairs of holes (45) in the plugs (42,44) are aligned with the apertures (32) in the plate (30) for receiving respective filter elements (16) therein. Adjacent each aperture (32) in the plate there is integrally formed with the plate (32) a resilient contact finger (36) which lies adjacent and parallel to the filter element (16). Disposed around the periphery of the metal plate (30) is a plurality of further fingers (38) which lie adjacent and parallel to the inner side wall of a tubular metal housing (34). A pair of rigid plates (46,48) disposed outboard of the rubber plugs (42,44) can be selectively brought together whereby to compress the plugs therebetween. The resulting lateral distortion of the plugs is arranged to have a three-fold effect. Fristly, the filter elements are gripped tightly in the holes in the plugs. Secondly, the fingers (36) are urged into good electrical contact with the periphery of the filter elements and thirdly the fingers (38) are urged into good electrical contact with the inner peripheral wall of the housing (34).

5 Claims, 13 Drawing Figures

ELECTRICAL CONNECTORS

DESCRIPTION

The present invention relates to electrical connectors and in particular to a connector which provides for easy connection and disconnection of its connecting parts.

There are many known ways of making an electrical connection. These include soldering, in which the connecting conducting elements are permanently fixed together, and mechanical connections in which, for instance, sprung metallic fingers press against other conducting elements to form connections.

This latter type of mechanical connection is generally unsatisfactory as vibrational conditions and oxidation effects can cause increased contact resistance and consequent degradation of the electrical contact. However, disconnection is easily achieved by pulling the conducting elements apart. Soldered connections on the other hand are able to maintain proper electrical contact over a wide range of environmental conditions but are permanent.

Another form of electrical connection utilizes a plug of conductive rubber which contains a number of moulded holes which provide an interference fit for conducting elements which are to be connected to the plug. However, this method has the disadvantage that the long term electrical performance of the connection relies on the compressed conductive rubber being free from gradual deformation of "creep" around the conducting elements.

"Creep" results in a decrease in contact pressure and a consequent increase in contact resistance.

This latter type of electrical connection allows disconnection in an easy manner by pulling the conducting elements out of the rubber. However, any "set" which occurs in the rubber due to a slightly large conducting element being inserted into the rubber, will result in a loose fit and bad electrical contact when a conducting element of smaller dimensions (due, for example, to manufacturing tolerances) is inserted as a replacement.

It is an object of the present invention to provide an electrical connector which provides a reliable electrical connection and which allows easy connection and disconnection of its connecting parts.

In accordance with the present invention, there is provided an electrical connector comprising a deformable resilient member having a hole therethrough for accommodating a conducting element, a mechanism for selectively stressing said resilient member so as to deform said hole from a first condition in which the hole can easily receive or release said conducting element to a second condition in which said conducting element is securely held in said hole, and at least one contact element received in the hole in the resilient member such that when the resilient member is stressed by said mechanism to deform said hole to said second condition to hold the conducting element in the hole, the resilient member urges said contact element into electrical engagement with the conducting element.

Preferably, the resilient member comprises a rubber plug which can be selectively deformed by moving together a pair of rigid retaining plates between which the rubber plug is positioned, the deformation of the rubber plug causing the hole in the rubber to partially collapse and urge the contact element against the conducting element therein, thereby making said electrical engagement therebetween.

It is also preferred for the contact element to be integrally connected to a metal plate which lies in a plane perpendicular to the axis of the hole in the resilient member and which contains an aperture generally axially aligned with the hole in the resilient member which receives said conducting element.

The deformation of the resilient member can then be used to urge a plurality of fingers, disposed integrally around the periphery of said metal plate and extending substantially perpendicular thereto, into electrical engagement with the inside surface of a tubular metal casing in which the connector is housed, to electrically connect the conducting element to said casing by way of said metal plate.

Advantageously, there are two or more, preferably three, metal plates disposed in a stack adjacent the resilient member, the plates containing respective apertures generally axially aligned with said hole in the resilient member, electrical connection between the conducting element received in that hole, and each metal plate being achieved by means of a respective contact element in the form of a finger formed integrally with the metal plate at one side of the aperture therein and of length greater than the radius of said aperture.

The invention is described further hereinafter, by way of example only, with reference to the accompanying drawings in which.

Figure 6A:
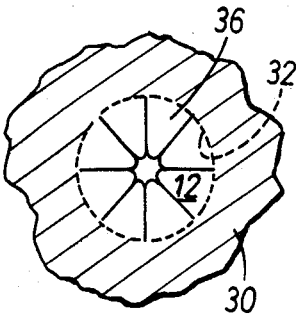
Figure 6B:
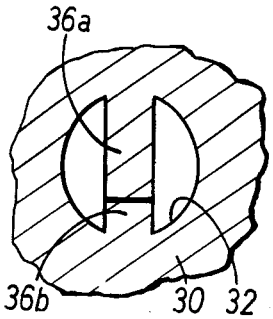
Figure 6C:
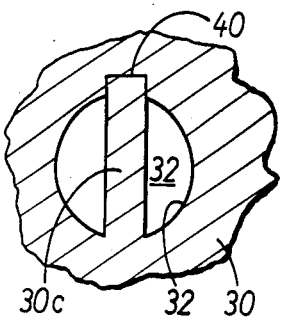
Figure 7:
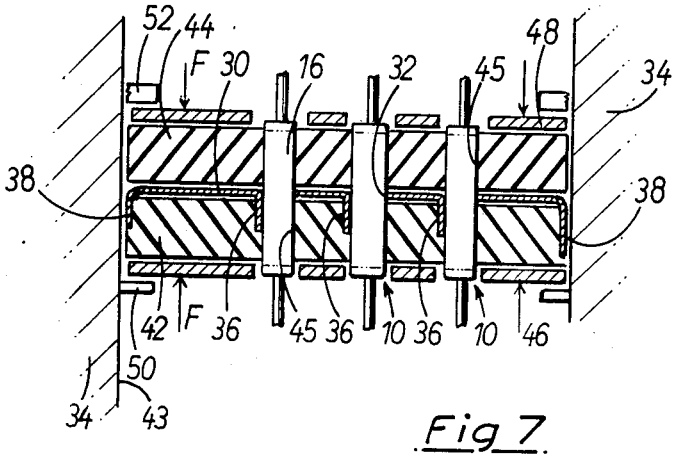
Figure 8:
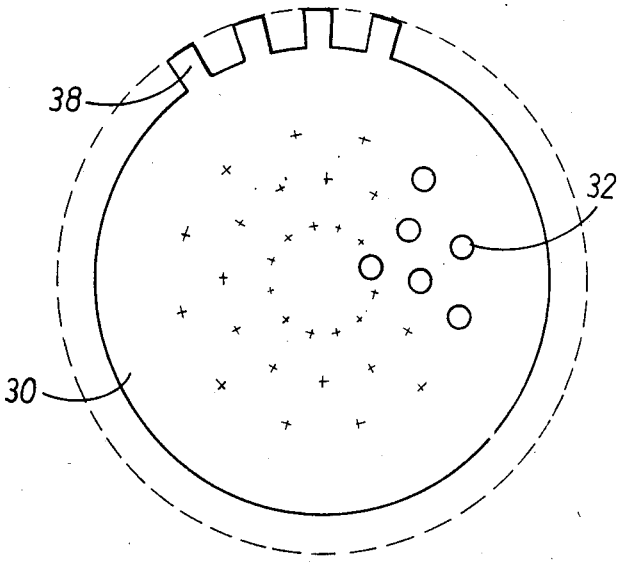
Figure 10:
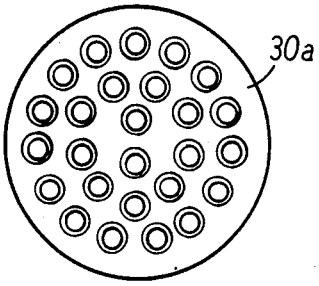
Figure 9:
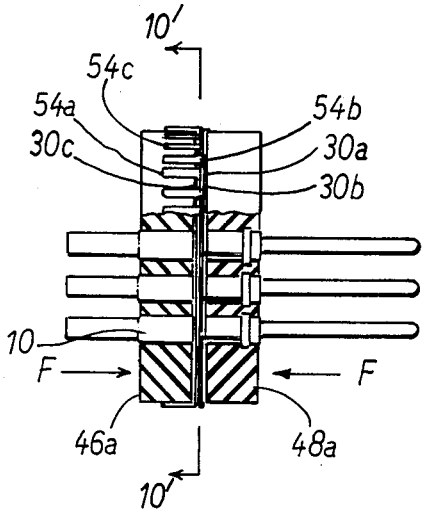

FIG. 6*a* shows diagrammatically a plate formed with a hole containing a plurality of fingers of length less than the radius of the hole;

FIG. 6*b* shows diagrammatically a plate formed with a hole containing two fingers, one of which is of length greater than the radius of the hole;

FIG. 6*c* shows diagrammatically a plate formed with a hole containing a single finger of length greater than the diameter of the hole;

FIG. 7 is a diagrammatic sectional side view of an embodiment in accordance with the present invention;

FIG. 8 is a plan view of a metal plate forming part of the embodiment of FIG. 7 and carrying a plurality of peripheral fingers;

FIG. 9 is a partially sectioned, side view of a further embodiment in accordance with the present invention;

FIG. 10 is a sectional view on the line 10—10 in FIG. 9; and

Figure 10A:
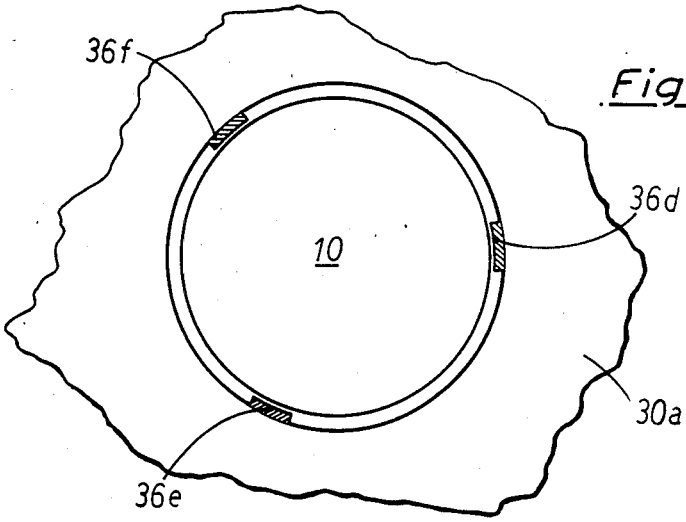

FIG. 10*a* is an enlarged detail of FIG. 10.

Figure 1:
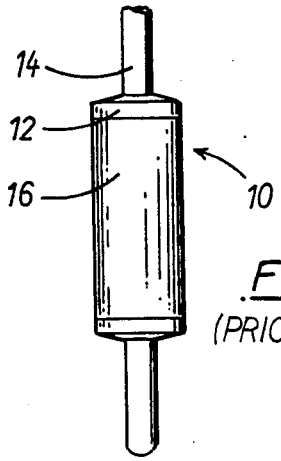
Fig 1 (PRIOR ART)
FIG. 1 is a schematic diagram of a typical prior art RFI suppression filter element.
Figure 2:
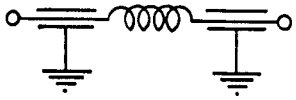
Fig 2 (PRIOR ART)
FIG. 2 shows the circuit representation for the filter of FIG. 1.

FIG. 1 shows a typical RFI suppression filter element 10 having a ceramic tubular part 12, a lead-through wire 14 and an outer tubular electrode 16. FIG. 2 shows the electrical configuration of the filter element 10 as a pi-section filter. It can be seen from FIG. 2 that it is necessary to provide an electrical ground connection to the outer electrode 16. This can be achieved by incorporating the filter 10 into a connector, connecting the outer electrode 16 to the connector casing and grounding the casing.

It is necessary that R.F.I. suppression filters operate over a wide range of frequencies, typically extending to at least 1 GHz. Because of this requirement, it is important to minimize resistance and inductance between the outer electrode 16 and the connector casing.

It is desirable also that the filter element 10 can be easily removed from the connector, for instance for replacement. Also it is preferable that the connection to the outer electrode 16 remains electrically sound even if subjected to considerable mechanical vibration.

Figure 3:
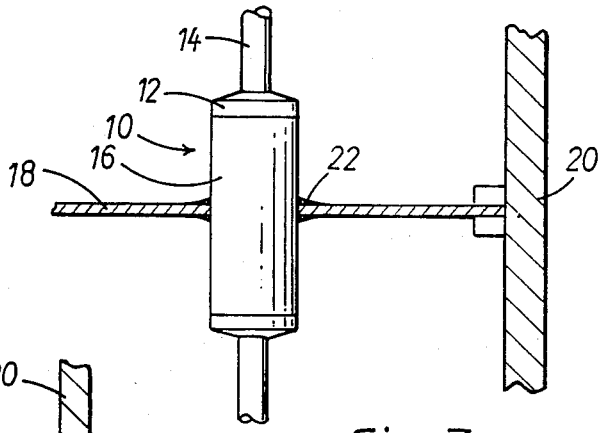
Fig 3 (PRIOR ART)
FIG. 3 is a schematic diagram showing a known prior art method of forming an electrical connection.

FIG. 3 shows one possible known technique for making a connection to the outer electrode 16 wherein a metal plate 18 is soldered to and around the electrode 16. The metal plate 18 is clamped to the connector casing 20 for grounding. Soldering certainly provides a reliable connection under most conditions but has, however, the disadvantage that easy removal of the filter is prevented.

Figure 4:
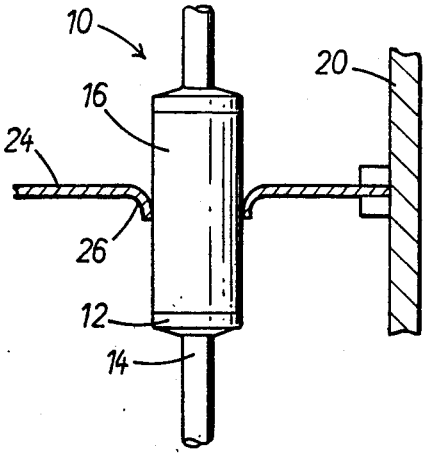
Fig 4 (PRIOR ART)
FIG. 4 is a schematic diagram showing another known prior art method of forming an electrical connection.

FIG. 4 shows an alternative method of making a connection to the electrode 16, using a metal plate 24 with integral sprung fingers 26. These fingers are intended to make a pressure contact onto the outer electrode 16 of the filter 10. R.F.I. suppression filters are removable using this technique. However, the retention force provided by the sprung fingers on the metal plate is low, and, if acceptable long term performance is to be achieved, some additional form of contact retention is required to withstand the normal connector insertion and extraction forces of the connector 20.

Figure 5:
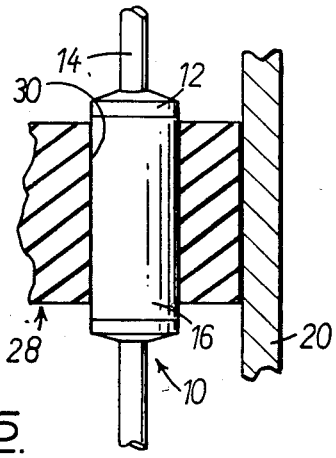
Fig 5 (PRIOR ART)
FIG. 5 is a schematic diagram showing a further known prior art method of forming an electrical connection.

Another known connecting technique is shown in FIG. 5. This utilizes a plug of rubber 28, loaded with, for example, metal particles to make it conductive. The connection is thus achieved by pushing the filter 10 into a moulded hole 30 which provides an interference fit for the filter 10 in the rubber 28. This technique is effective electrically by providing a circumferential connection. However, the long term electrical performance relies on the compressed rubber being free from "creep" around the filter 10. "Creep" causes reduction in contact pressure and an increase in contact resistance between electrode 16 and connector 20. The filter 10 may be changed readily. However, any "set" which occurs in the rubber due to a slightly large filter being inserted into the rubber plug 28, will ensure a loose fit and a bad electrical contact when a filter of smaller dimensions (due for example to manufacturing tolerances) is inserted as a replacement.

The force required to pull the filter 10 out of the rubber plug 28 is determined by an acceptable insertion force, that is, by the interference fit. Also the insertion force must be small enough to prevent the filter 10 from damaging the rubber plug 28 on insertion. The type of connection shown in FIG. 5 is therefore unacceptable for medium and long term use.

Referring now to FIGS. 7 and 8, there is shown one embodiment of a connector in accordance with the present invention. This employs a metal disc 30 formed with a plurality of circular holes 32 for receiving therein a corresponding plurality of conductive elements, such as filter elements 10 of the type shown in FIG. 1. It is required that the outer peripheral surfaces 16 of the filter elements 10 be electrically connected to the metal plate 30 which is itself to be electrically connected to a surrounding metal housing 34 in which, in use, the connector is mounted.

To achieve this, the metal plate 30 is formed with a first plurality of integral fingers 36 formed adjacent to the holes 32 and bent at right angles to the plane of the plate 30, as shown in FIG. 7. The plate 30 also carries a second plurality of fingers 38 disposed around its periphery and again bent at right angles to the plane of the plate as shown in FIG. 7.

Three possibilities for the formation and configuration of the fingers 36 are illustrated in more detail in FIG. 6 by way of example. In FIG. 6*a*, the plate 30 is formed with eight fingers 36 which, when they are bent at right angles to the plate 30, leave a substantially circular hole 32 (indicated by dotted line in FIG. 6*a*) for the reception of a respective filter element 10. In FIG. 6*b*, the plate 30 is formed with two fingers 36*a*, 36*b* of combined length equal to the diameter of the hole 32, one of these two fingers being longer than the other. In FIG. 6*c*, the plate 30 is formed with a single finger 36*c* of length greater than the diameter of the associated hole 32. This latter finger length is obtained by leaving a cut-out notch 40 in the side wall of the aperture 32 opposite to the point of connection of the finger 36*c* with the plate 30.

Referring again to FIGS. 7 and 8, disposed on the two sides of the plate 30 are a pair of circular rubber plugs 42,44, each of which has a plurality of apertures 45 for receiving the plurality of filter elements 10 and, in the case of the plug 42, the fingers 36. Disposed outboard of the plugs 42 and 44 are two rigid plates 46,48. A suitable clamping means is provided for selectively displacing the two rigid plates 46,48 towards one another to compress the rubber plugs, with the metal plate 30 sandwiched between them. The clamping means can be of any suitable form capable of achieving the required displacement of the plates 46,48 to compress the rubber plugs. For example, a fixed stop ring 50 can be positioned on the housing 34 so as to engage beneath the plate 46 and an externally screw-threaded ring 52 can be positioned above the plate 48, the latter ring 52 being received in a correspondingly screw-threaded portion of the housing 34. The required compression of the plugs 42,44 is achieved by screwing the ring 52 into the housing 34 towards the fixed stop ring 50.

The arrangement is such that, upon compressing the rubber plugs 42,44 together, the resulting lateral deformation of the plugs 42,44 causes the filter elements to be tightly gripped in the apertures 30 by the rubber. The deformation of the plug 42 also urges the flexible fingers 36 into firm engagement with the peripheries of the adjacent filter elements 10 and urges the fingers 38 outwardly into firm engagement with the wall 43 of the metal housing 34. By this means, a good electrical connection is achieved between the peripheral surfaces 16 of the filter elements 10 and the metal housing 34 (which would normally be grounded). At the same time, the filter elements are held securely in their operative positions.

Upon release of the compressive forces on the rubber plugs (indicated by arrows F in FIG. 7), the grip on the filter elements 10 is relaxed and they can be withdrawn easily from the apertures in the metal plate 30 and from the holes 45 in the rubber plugs.

In some embodiments, the rubber used to fabricate the plugs (or at least the plug 42) can be of a type which contains metal particles and is therefore itself electrically conductive. This assists in providing a good electrical connection between the peripheries of the filter elements 10 and the metal housing 34.

FIGS. 9 and 10 show another embodiment, similar in principle to that of FIGS. 7 and 8. However, instead of the single metal plate 30 of FIGS. 7 and 8, the embodiment of FIGS. 9 and 10 employs three metal plates 30*a*, 30*b*, 30*c* stacked one above the other as best seen in FIG. 9. Each of these three plates 30*a*, 30*b*, 30*c* includes a complete set of apertures 32 for receiving the required plurality of filter elements, the sets of apertures 32 on the three plates being mutually aligned. Each aperture 30 has a single finger 36 associated with it, formed as in FIG. 6*c* so as to be of greater length than the diameter of that aperture. However, for each set of three aligned apertures 32 in the three plates 30 which receive the same filter element 10, the positions of the three corresponding fingers 36*d*, 36*e* and 36*f* on the three plates are displaced relatively by 120° (see FIG. 10*a*). Thus, upon compressing the rubber plugs 46*a*, 48*a* by application of the forces F, each filter element 10 is not only gripped by the rubber plugs but is contacted by three separate fingers 36*a*, 36*b* and 36*c* which are spaced 120° apart and are carried by the three plates 30*a*, 30*b* and 30*c*, respectively. An improved electrical connection with the peripheral surfaces 16 of the filter elements is thereby obtained.

Each plate 30*a*, 30*b*, 30*c* also carries a respective plurality of peripheral fingers 54*a*, 54*b*, 54*c* corresponding to the fingers 38 of FIGS. 7 and 8. The fingers are angularly spaced on each plate 30*a*, 30*b*, 30*c* so that, when the plates are stacked one on top of the other, the fingers lie in sequence 54*a*, 54*b*, 54*c*, 54 a, 54*b* . . . etc. around the periphery of the stack.

By this means a very reliable contact can be made between the peripheral surfaces 16 of the filter elements 10 and the housing 34.

In theory any number of plates 30 could be used. However, in practice, there is probably an ideal number to achieve excellent contact reliability without undue mechanical complexity.

We claim:

1. An electrical connector assembly comprising a deformable resilient member disposed within a tubular metal casing and having a hole therethrough for accommodating a conducting element, a mechanism for selectively stressing said resilient member so as to deform said hole from a first condition in which the hole can easily receive or release said conducting element to a second condition in which said conducting element is securely held in said hole, at least one metal plate which lies in a plane perpendicular to the axis of the hole in the resilient member and which contains an aperture generally axially aligned with the hole in the resilient member which receives said conducting element, and at least one conductive contact element received in the hole in the resilient member, the conductive contact element being integral with said metal plate, there being disposed integrally around the periphery of said metal plate and extending substantially perpendicular thereto a plurality of conductive fingers so that when the resilient member is stressed by said mechanism to deform said hole to said second condition to hold the conducting element in the holes, the deformation of the resilient member urges said contact element into electrical engagement with the conducting element and urges said plurality of fingers into electrical engagement with the inside surface of said tubular metal casing, to electrically connect the conducting element to said tubular metal casing by way of said metal plate.

2. An electrical connector assembly according to claim 1, wherein the resilient member comprises a rubber plug which can be selectively deformed by moving together a pair of rigid retaining plates between which the rubber plug is positioned, the deformation of the rubber plug causing the hole in the rubber to partially collapse and urge the contact element against the conducting element therein, thereby making said electrical engagement therebetween.

3. An electrical connector assembly according to claim 2, wherein the diameter of the hole through the rubber plug is slightly larger than the diameter of the conducting element which is to be inserted therein, thereby enabling the conducting element to be inserted and removed into the rubber with zero insertion and extraction force when the retaining plates are in their retracted condition.

4. An electrical connector assembly according to claim 2, wherein the rubber plug contained a plurality of holes for receiving a corresponding plurality of conducting elements.

5. An electrical connector comprising a tubular metal housing, at least one metal plate disposed within said tubular metal housing transverse to the tubular axis and containing a plurality of apertures, two resilient rubber plugs disposed one on each side of the metal plate so as to sandwich the metal plate therebetween, the rubber plugs each having a plurality of holes therein with pairs of the holes in the two plugs aligned generally axially with respective apertures in the metal plate, the pairs of aligned holes in the rubber plugs being dimensioned to receive therewithin a respective circularly-sectioned conducting element having a conductive peripheral surface portion, a respective first contact finger formed integrally with the metal plate adjacent each aperture in the plate and extending in a direction perpendicular to the plate so as to lie generally parallel to the conducting surface of a said conducting element when the latter is inserted into the pair of holes in the rubber plugs, a plurality of second contact fingers formed integrally with the metal plate around the periphery thereof and extending in a direction perpendicular to the plate, and a means for selectively axially compressing the resilient plugs so as to distort said plugs laterally sufficient (a) to grip the conducting elements in said holes, (b) to urge the first contact fingers into engagement with said conducting surfaces of the conducting elements and (c) to urge the second contact fingers into engagement with the inner peripheral surface of said tubular metal housing.

* * * * *